US009580206B2

(12) United States Patent
Huels et al.

(10) Patent No.: US 9,580,206 B2
(45) Date of Patent: Feb. 28, 2017

(54) BOTTOM STRUCTURE FOR A PLASTIC BOTTLE

(75) Inventors: Peter Huels, Kroev (DE); Roland Concin, Stallehr (AT); Gabriele Weber-Trinkfass, Salzburg (AT); Andrea Kutscheid, Santa Monica, CA (US); Tilmann Kessler, Neumarkt am Wallersee (AT)

(73) Assignee: Red Bull GmbH, Fuschl am See (AT)

( * ) Notice: Subject to any disclaimer, the term of this patent is extended or adjusted under 35 U.S.C. 154(b) by 131 days.

(21) Appl. No.: 13/825,545

(22) PCT Filed: Sep. 21, 2011

(86) PCT No.: PCT/EP2011/004717
§ 371 (c)(1),
(2), (4) Date: Jun. 12, 2013

(87) PCT Pub. No.: WO2012/038075
PCT Pub. Date: Mar. 29, 2012

(65) Prior Publication Data

US 2013/0270214 A1 Oct. 17, 2013

(30) Foreign Application Priority Data

Sep. 22, 2010 (AT) ..... A 1577/2010

(51) Int. Cl.
*B65D 1/02* (2006.01)
*B65D 23/00* (2006.01)

(52) U.S. Cl.
CPC ..... *B65D 23/001* (2013.01); *B65D 1/0276* (2013.01); *B65D 1/0284* (2013.01); *B65D 1/0261* (2013.01)

(58) Field of Classification Search
CPC ..... B65D 23/001; B65D 1/04; B65D 90/12; B65D 23/00; B65D 2501/0036; B65D 1/0276; B65D 1/0284
(Continued)

(56) References Cited

U.S. PATENT DOCUMENTS 3,043,461 A * 7/1962 Glassco ..... 215/375
3,137,748 A * 6/1964 Makowski ..... 264/537
(Continued)

FOREIGN PATENT DOCUMENTS

DE 1801368 A1 5/1969
EP 140792 A2 5/1985
(Continued)

OTHER PUBLICATIONS

Hans de Grys, "Determining the Pressure inside an Unopened Carbonated Beverage". Jul. 2007. Journal of Chemical Education. vol. 84 No. 7.*
(Continued)

*Primary Examiner* — J. Gregory Pickett
*Assistant Examiner* — Gideon Weinerth
(74) *Attorney, Agent, or Firm* — TechMark a Law Corporation; Martin R. Greenstein

(57) ABSTRACT

This invention relates to a base for a plastic bottle, especially for beverages under pressure, comprising an annular heel (6) which preferably is integral with the side wall (2) of the bottle, and a concave section (7) that is surrounded by, and integral with, the heel (6), wherein the concave section (7) comprises reinforcing elements arranged in a star pattern and increasing its rigidity, wherein the reinforcing elements are formed by convex areas (9) of the concave section (7) and the concave section (7) including the convex area (9) have essentially the same wall thickness.

5 Claims, 2 Drawing Sheets

Figure 1:
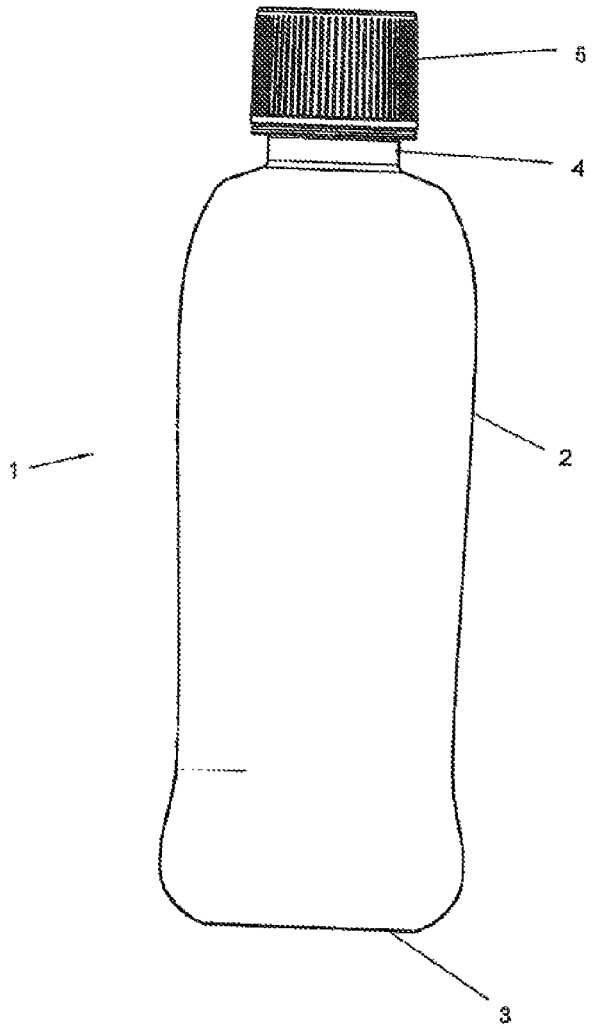

(58) Field of Classification Search
USPC ..... 215/377, 382, 373, 376, 372, 371; 220/606, 608; 428/66.3, 36.92; D9/516, D9/520
IPC ..... B65D 23/001,1/04, 90/12, 23/00, 2501/0036, 1/0276, 1/0284
See application file for complete search history.

(56) References Cited

U.S. PATENT DOCUMENTS

| | | | | |
|---|---|---|---|---|
| 3,468,443 | A * | 9/1969 | Marcus | 215/375 |
| 3,643,829 | A * | 2/1972 | Lachner | 215/373 |
| 3,881,621 | A * | 5/1975 | Adomaitis | 215/373 |
| 3,934,743 | A * | 1/1976 | McChesney et al. | 215/373 |
| 4,108,324 | A * | 8/1978 | Krishnakumar et al. | 215/373 |
| 4,174,782 | A * | 11/1979 | Obsomer | 215/373 |
| 4,249,666 | A * | 2/1981 | Hubert et al. | 215/373 |
| 4,276,987 | A * | 7/1981 | Michel | 215/373 |
| 4,355,728 | A * | 10/1982 | Ota et al. | 215/375 |
| 4,465,199 | A * | 8/1984 | Aoki | 215/373 |
| 4,525,401 | A * | 6/1985 | Pocock et al. | 428/66.3 |
| 4,598,831 | A * | 7/1986 | Nakamura et al. | 215/373 |
| 4,863,046 | A * | 9/1989 | Collette et al. | 215/381 |
| 4,892,205 | A * | 1/1990 | Powers et al. | 215/375 |
| 5,005,716 | A * | 4/1991 | Eberle | 215/373 |
| D320,154 | S * | 9/1991 | Alberghini et al. | D9/520 |
| 5,205,434 | A * | 4/1993 | Brunson et al. | 220/608 |
| 5,320,230 | A * | 6/1994 | Hsiung | 215/375 |
| 5,492,245 | A * | 2/1996 | Kalkanis | 220/609 |
| 5,503,283 | A * | 4/1996 | Semersky | 215/375 |
| 5,553,753 | A | 9/1996 | Abplanalp | |
| 5,593,063 | A * | 1/1997 | Claydon et al. | 220/608 |
| 5,603,423 | A * | 2/1997 | Lynn et al. | 215/375 |
| 5,763,030 | A * | 6/1998 | Matsui | 428/35.7 |
| 5,780,130 | A * | 7/1998 | Hansen et al. | 428/35.7 |
| 5,785,197 | A * | 7/1998 | Slat | 215/375 |
| 5,829,614 | A * | 11/1998 | Collette et al. | 215/375 |
| 5,908,128 | A * | 6/1999 | Krishnakumar et al. | 215/381 |
| 6,045,001 | A * | 4/2000 | Seul | B29C 49/18 215/371 |
| 6,065,624 | A * | 5/2000 | Steinke | B65D 1/0276 215/373 |
| D445,033 | S * | 7/2001 | Bretz et al. | D9/520 |
| 6,409,035 | B1 * | 6/2002 | Darr et al. | 215/373 |
| 6,585,123 | B1 * | 7/2003 | Pedmo et al. | 215/10 |
| 6,595,380 | B2 * | 7/2003 | Silvers | 215/373 |
| 6,634,517 | B2 * | 10/2003 | Cheng et al. | 215/373 |
| 6,769,561 | B2 * | 8/2004 | Futral et al. | 215/373 |
| 6,896,147 | B2 * | 5/2005 | Trude | 215/373 |
| 6,908,002 | B2 * | 6/2005 | Young et al. | 215/375 |
| 7,051,889 | B2 * | 5/2006 | Boukobza | 215/375 |
| 7,185,525 | B2 * | 3/2007 | Werth et al. | 72/379.4 |
| 7,416,089 | B2 | 8/2008 | Kraft et al. | |
| 7,461,756 | B2 * | 12/2008 | Pedmo et al. | 215/375 |
| 7,543,713 | B2 * | 6/2009 | Trude et al. | 215/373 |
| 7,556,164 | B2 * | 7/2009 | Tanaka | B65D 1/0276 215/371 |
| D606,410 | S * | 12/2009 | Kissinger et al. | D9/516 |
| 7,780,025 | B2 | 8/2010 | Simpson, Jr. et al. | |
| D627,652 | S * | 11/2010 | Dorn | D9/516 |
| D630,515 | S * | 1/2011 | Bretz et al. | D9/520 |
| 7,861,876 | B2 * | 1/2011 | Stowitts | 215/381 |
| D632,576 | S * | 2/2011 | Hermel | D9/519 |
| 7,891,513 | B2 * | 2/2011 | Mody et al. | 215/375 |
| 7,891,968 | B2 * | 2/2011 | Lesueur | 425/522 |
| 7,900,425 | B2 * | 3/2011 | Bysick et al. | 53/440 |
| 7,963,088 | B2 * | 6/2011 | Simpson et al. | 53/440 |
| 8,011,919 | B2 * | 9/2011 | Penet et al. | 425/522 |
| D648,220 | S * | 11/2011 | Dorn | D9/516 |
| D651,901 | S * | 1/2012 | Miller et al. | D9/516 |
| 8,096,434 | B2 * | 1/2012 | Bunel et al. | 215/376 |
| 8,152,010 | B2 * | 4/2012 | Melrose | 215/373 |
| 8,245,872 | B2 * | 8/2012 | Hanot et al. | 220/613 |
| 8,308,006 | B2 * | 11/2012 | Nievierowski et al. | 215/381 |
| 8,424,709 | B2 * | 4/2013 | Boukobza | 220/675 |
| 8,444,002 | B2 * | 5/2013 | Schneider et al. | 220/608 |
| 8,529,975 | B2 * | 9/2013 | Trude et al. | 426/399 |
| 8,584,879 | B2 * | 11/2013 | Melrose et al. | 215/373 |
| 8,590,729 | B2 * | 11/2013 | Kamineni et al. | 220/609 |
| 8,662,332 | B2 * | 3/2014 | Wurster et al. | 215/383 |
| 8,726,616 | B2 * | 5/2014 | Bysick et al. | 53/440 |
| 8,881,937 | B2 * | 11/2014 | Derrien | B65D 1/0261 220/675 |
| 2002/0063105 | A1 * | 5/2002 | Darr et al. | 215/373 |
| 2004/0000533 | A1 * | 1/2004 | Kamineni et al. | 215/373 |
| 2004/0195199 | A1 * | 10/2004 | Maki et al. | 215/381 |
| 2005/0127024 | A1 * | 6/2005 | Darr | 215/382 |
| 2005/0139571 | A1 * | 6/2005 | Darr | 215/377 |
| 2006/0131257 | A1 * | 6/2006 | Gatewood et al. | 215/373 |
| 2007/0231530 | A1 | 10/2007 | Pedmo et al. | |
| 2008/0047964 | A1 * | 2/2008 | Denner et al. | 220/624 |
| 2009/0159556 | A1 * | 6/2009 | Patcheak et al. | 215/373 |
| 2009/0202766 | A1 * | 8/2009 | Beuerle et al. | 428/36.9 |
| 2009/0242575 | A1 | 10/2009 | Kamineni et al. | |
| 2010/0219152 | A1 * | 9/2010 | Derrien et al. | 215/374 |
| 2011/0049083 | A1 * | 3/2011 | Scott | B65D 1/0276 215/371 |
| 2011/0147392 | A1 * | 6/2011 | Trude et al. | 220/606 |
| 2013/0001235 | A1 * | 1/2013 | Patcheak et al. | 220/609 |

FOREIGN PATENT DOCUMENTS

| | | | |
|---|---|---|---|
| EP | 237196 | A1 | 9/1987 |
| GB | 2034663 | A | 6/1980 |
| JP | 04-294735 | A | 10/1992 |
| JP | 2002-308245 | A | 10/2002 |
| JP | 2004-149157 | A | 5/2004 |
| JP | 2005-112361 | A | 4/2005 |
| JP | 2005-119742 | A | 5/2005 |
| JP | 2009-208813 | A | 9/2009 |
| WO | 2007060529 | A2 | 5/2007 |
| WO | 2009120988 | A2 | 10/2009 |

OTHER PUBLICATIONS

Ottmar Brandau, "How to Address Uneven Wall Thickness in Stretch-Blow Molding", Plastics Technology, Dec. 2014, Accessed Jun. 8, 2016.

* cited by examiner

BOTTOM STRUCTURE FOR A PLASTIC BOTTLE

The invention relates to a base for a plastic bottle, especially for beverages under pressure, comprising an annular heel that is preferably integral with the side wall of the bottle, and a concave section that is surrounded by, and integral with, the heel, wherein the concave section comprises reinforcing elements arranged in a star pattern that increase its rigidity.

The invention further relates to a plastic bottle for beverages under pressure having a base whose annular heel is preferably integral with the side wall of the bottle.

A base of the type mentioned at the outset can be found, for example, in DE-OS 1801368.

Plastic bottles are only suitable for holding and storing beverages and the like under pressure if they meet specific design prerequisites. One of the main difficulties that arise when using plastic bottles for this stated purpose is that the center part of the base of the bottle tends to deflect or bulge outwardly beyond the rim of the base, creating positional instability of such bottles. It has become known to design the bottle base as a champagne bottle-type base or petaloid base. A champagne bottle-type base is curved inwardly and can therefore withstand a specific internal pressure without being deflected outwardly. The champagne bottle-type base is particularly common on glass bottles. Suitability of plastic bottles for beverages under pressure depends decisively on the wall thickness of the base. If the base wall is too thin, the bottle structure is too flexible, and excessive bulging of the bottle base cannot be prevented. If the base wall is too thick, material consumption and the manufacturing costs and weight of the bottle will be too high. Champagne bottle-type bases of the conventional type can no longer be used economically from a specific $CO_2$ concentration of the beverage. A petaloid base comprises constrictions that extend up the side walls and between which curved, petal-shaped areas are formed. Petaloid bases are very common, especially in plastic bottles, and they withstand high internal pressure even if the base wall is relatively thin. Disadvantages are less positional stability and in particular the smaller static tipping angle, so that the risk that this bottle topples over is greater than for a comparable bottle with a champagne bottle-type base. The appearance of the bottle is also impaired by the petaloid areas that extend up to the side wall.

Various attempts have been made to improve the strength or rigidity of champagne bottle-type bases for use in plastic bottles. DE-OS 1801368, for example, proposes reinforcing ribs arranged in a star pattern in the concave bottle base, which however result in excessive material consumption since the reinforcing ribs are made of material added to the base, thereby also increasing the weight of the bottle. In addition, producing such a bottle base takes a much greater effort than producing a simple champagne bottle-type base.

It is the object of this invention to improve the base for a plastic bottle such that the bottle is suitable for storing beverages under high pressure while being lightweight and economical in material consumption. Manufacture should be easy, cost-efficient and automated with short cycle times. The bottle should also have an attractive and high-quality appearance; in particular, its base should not entail any restrictions in the design of the bottle.

This object is essentially achieved in a base of the type mentioned at the outset in that reinforcing elements are formed of convex areas of the concave section and in that the concave section, including the convex areas are essentially of a uniform wall thickness. The base starts from the shape of a champagne bottle-type base, and the invention proposes elements to rigidify the concave base section such that the material consumption is not or just negligibly higher than for a simple champagne bottle-type base. The stiffening elements provided according to the invention do not result in any material thickening since they are just formed from the convex areas of the concave base section. It was surprisingly found that such stiffening areas result in a very rigid structure even with very thin base walls, and even very high internal pressures of the bottle do not cause any outward deflection of the base.

Due to the base, the plastic bottle can be manufactured in a simple manner using conventional and proven methods. Especially bottles made of polyethylene terephthalate (PET) are preferably manufactured from a so-called PET preform, an injection-molded preform. The process from a PET preform to a PET bottle runs through the following steps: The preform is initially heated up, that is, a temperature profile in accordance with the desired wall thickness distribution is introduced into the preform. Infrared radiant heaters may be used, for example. Then the preform is chucked in a three-piece mold, a thorn moves into the preform and stretches it to the final length of the bottle. Compressed air blows the tube produced in this way into its final shape, and then the bottle is brought to a temperature below the glass transition temperature by cooling the mold. Finally, the mold opens and the finished bottle is ejected.

The mold just has to be adapted in the base region to accomplish the base according to the invention, but the general process remains the same and no additional process steps are required. The concave section including the convex areas can easily be produced with an essentially uniform wall thickness using the manufacturing process described. "Essentially" means that the wall thickness may vary slightly due to the manufacturing process, e.g. when the material in the convex areas is stretched to a greater extent than the adjacent areas when the preform is pressed against the mold, such that the base may be slightly thinner in these areas.

The convex areas preferably have an oblong shape, i.e. their radial extension is greater than their circumferential extension. This results in a particularly stable base.

According to a preferred development of the invention, the convex areas are at a spacing from one another in the circumferential direction. The convex areas are evenly distributed, especially in the circumferential direction 3, 4, 5, 7, 8, 9, 10, 11, or 12 such areas are conceivable depending on the diameter of the bottle.

In addition to reinforcing the concave base section, the convex areas can also serve as contact area of the bottle. For this purpose, it is preferably designed such that the convex areas include a section parallel to, or forming, a contact area. The section parallel to the contact area may, for example, comprise a bulge or the like protruding from the contact area.

Alternatively, or in addition to the contact area that is formed by the sections of convex stiffening areas mentioned, the bottle may also rest as usual on the heel of the base. In this case, the annular heel of the base comprises a contact area of the base. Thus the base of the bottle is in ground contact along the heel of the base like a conventional bottle with a champagne bottle-type base. This allows the consideration of aesthetic requirements and high-quality bottle design like with champagne bottles, where the side walls can extend to the base in free-form design, and no stiffening elements or the like are visible.

Good stiffening characteristics can be achieved if—according to a preferred development—the convex areas include curved sections in the lateral and inward radial directions adjacent to the section parallel to the contact area or forming a contact area.

The stability of the base can be further improved if the convex areas surround a central concave area.

Another improvement of the stability of the base can preferably be achieved in that the base comprises at least one annular groove, especially next to the heel or between the convex areas and the heel.

Yet another improvement of the stability of the base can preferably be achieved in that the base comprises at least one annular groove between the convex areas and the central concave area.

Yet another improvement of the stability of the base can preferably be achieved in that the base comprises an annular groove between the convex areas and the central concave area.

It is preferred that the convex areas comprise a radial extension that essentially corresponds to the radial distance between the heel and the central area, by which maximum stiffening is achieved.

As mentioned above, the base according to the invention is to be suitable for high internal pressures, wherein the internal pressure primarily depends on the $CO_2$ content of the beverage. In one advantageous development, the base is designed to withstand an internal pressure of the bottle at a $CO_2$ concentration of up to 5 g/L at a temperature of 20° C.

It is important that the walls are kept thin to achieve a cost-efficient and lightweight design consuming little material, however the wall thickness cannot be reduced arbitrarily for stability reasons. In a preferred embodiment in this respect the annular heel and/or the concave section has an average wall thickness equal to or smaller than 1.95 mm, preferably 1.5 mm, and the concave section does not exceed a wall thickness of 1.95 mm, preferably 1.5 mm, preferably 1 mm anywhere.

The invention is explained in more detail and with reference to the embodiment shown in diagrammatic view in the figure below.

Figure 2:
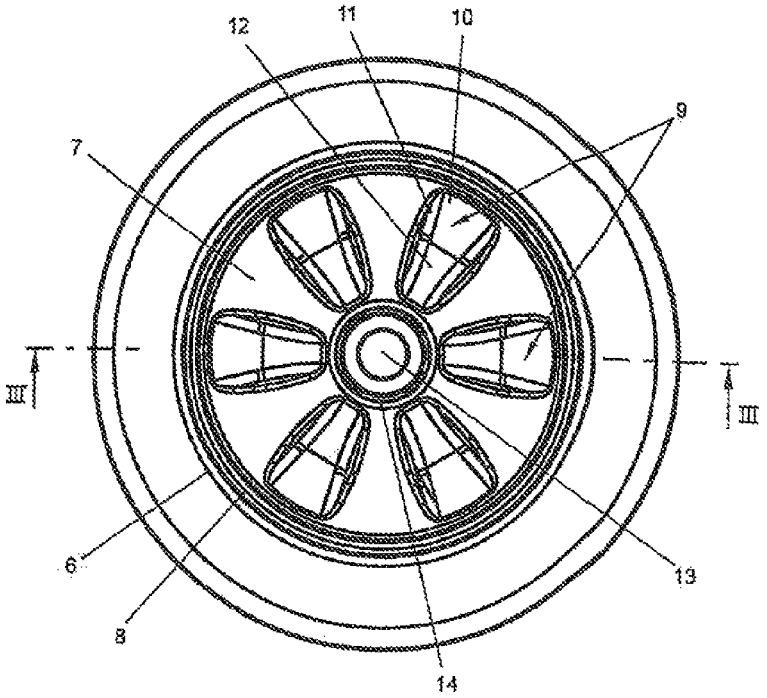

FIG. 1 shows a lateral view of a plastic bottle,

FIG. 2 a bottom view of the bottle, and

Figure 3:
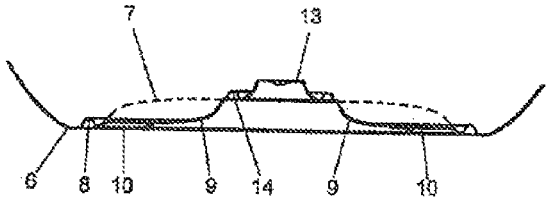

FIG. 3 a sectional view along the III-III line in FIG. 2.

FIG. 1 shows a plastic bottle, especially a PET bottle 1 comprising a side wall 2 and a base 3 that is integral with the side wall 2. The bottleneck 4 has a male thread not shown in the figure onto which the screw cap 5 is screwed.

FIG. 2 shows a bottom view of the base 3. The base 3 comprises an annular heel 6 with which the bottle has contact with a support surface. An annular groove 8 is provided between the heel 6 and the concave section 7. The concave section 7 comprises outwardly domed, that is, convex areas 9, each of which comprising a section 10 parallel to the contact area, curves sections 11 laterally adjacent to the section 10 that is formed parallel to the contact area, and curves sections 12 radially adjacent to the section 10 that is formed parallel to the contact area. Another annular groove 14 is provided between the convex areas 9 and the central concave area 13.

The sectional view shown in FIG. 3 better shows the curvatures of each of the convex areas 9 and that the wall thickness or material thickness of the base 3 is essentially the same throughout.

The features of the invention disclosed in the above description, the claims and the figures can be relevant both individually and in combination for implementing the various embodiments of the invention.

The invention claimed is:

1. A base for a plastic bottle for beverages under an internal pressure, the base comprising:

an annular heel which is integral with a side wall of the bottle and comprises a first contact area; and, an inwardly domed section that is surrounded by and integral with said heel, the inwardly domed section includes a plurality of reinforcing elements arranged in a star pattern for increasing a rigidity of the inwardly domed section to enable the plastic bottle to withstand internal pressures, wherein the plurality of reinforcing elements are comprised of outwardly domed areas of the inwardly domed section that have a rigid structure so as to withstand the internal pressure and are configured to resist an outward deflection of the base, wherein the base comprises at least one annular groove between the outwardly domed areas and the heel, wherein the inner circumferential edge and the outer circumferential edge of said annular groove are located radially outwardly beyond the outwardly domed area, wherein the inwardly domed section including the outwardly domed areas have essentially the same wall thickness, and wherein the outwardly domed areas are arranged in a spacing from one another in the circumferential direction, wherein the outwardly domed areas include a section parallel to the first contact area:

wherein the outwardly domed areas comprise curved sections in the lateral and inward radial directions adjacent to the section that is parallel to the first contact area and surround a central inwardly domed area, and the outwardly domed areas surround the central inwardly domed area, and wherein the base comprises at least one further annular groove between the outwardly domed areas and the central inwardly domed area.

2. The base according to claim 1, wherein the base is designed to withstand an internal pressure of the bottle at a $CO_2$ concentration of up to 5 g/L at a temperature of 20° C., said conditions according to the ideal gas law being equal to an internal pressure of approximately 2.73 atm (40.12 p.s.i.).

3. The base according to claim 1, wherein the outwardly domed areas include a section forming a second contact area.

4. A base for a plastic bottle for beverages under an internal pressure, the base comprising:

an annular heel being integral with a side wall of the bottle and comprising a first contact area; and, an inwardly domed concave section that is surrounded by and integral with a heel, the inwardly domed concave section comprising a plurality of reinforcing elements arranged in a star pattern for increasing a rigidity of the base so as to be able to withstand internal pressure in the bottle, wherein the plurality of reinforcing elements are formed by outwardly domed convex areas of the inwardly domed concave section, wherein the inwardly domed concave section including the outwardly domed convex areas has essentially the same wall thickness, wherein the outwardly domed convex areas are arranged in a spacing from one another in the circumferential direction, wherein the outwardly domed convex areas include a section parallel to the first contact area, wherein the outwardly domed convex areas comprise curved sections in the lateral and inward radial directions adjacent to the section that is parallel to the first contact area, wherein the outwardly domed convex areas surround a central inwardly domed concave area, wherein the base comprises at least a first annular groove radially located between the outwardly domed convex areas and the heel, and wherein the base comprises at least a second annular groove located between the outwardly domed convex areas and the central inwardly domed concave area.

5. The base according to claim 4, wherein an inner circumferential edge and an outer circumferential edge of said first annular groove are located radially outwardly beyond the outwardly domed area.

* * * * *